US009634446B2

(12) United States Patent
Chien et al.

(10) Patent No.: US 9,634,446 B2
(45) Date of Patent: Apr. 25, 2017

(54) CONNECTOR, DOCKING STATION AND CONNECTING ASSEMBLY WITH THE CONNECTOR

(71) Applicant: HCS AUDIO TECHNOLOGY LIMITED, Shatin (HK)

(72) Inventors: Mark Chien, Hong Kong (HK); Chul Chung, Hong Kong (HK); Lap Shun Hui, Santa Clara, CA (US)

(73) Assignee: HCS AUDIO TECHNOLOGY LIMITED, Shatin (HK)

( * ) Notice: Subject to any disclaimer, the term of this patent is extended or adjusted under 35 U.S.C. 154(b) by 0 days.

(21) Appl. No.: 14/858,042

(22) Filed: Sep. 18, 2015

(65) Prior Publication Data

US 2016/0087386 A1 Mar. 24, 2016

Related U.S. Application Data

(60) Provisional application No. 62/052,970, filed on Sep. 19, 2014.

(51) Int. Cl.

| | |
|---|---|
| ***H01R 24/00*** | (2011.01) |
| ***H01R 27/02*** | (2006.01) |
| ***H01R 12/72*** | (2011.01) |
| *H01R 24/60* | (2011.01) |

(52) U.S. Cl.

CPC ..... *H01R 27/02* (2013.01); *H01R 12/724* (2013.01); *H01R 24/60* (2013.01); *H01R 2201/06* (2013.01)

(58) Field of Classification Search

CPC .... H01R 13/6471; H01R 27/00; H01R 13/64; H01R 27/02; H01R 29/00; H01R 23/6873

See application file for complete search history.

(56) References Cited

U.S. PATENT DOCUMENTS

| | | | | |
|---|---|---|---|---|
| 7,364,464 | B2 * | 4/2008 | Iino | H01R 12/716 439/607.55 |
| 8,198,563 | B2 * | 6/2012 | Tsai | H01R 23/10 218/118 |
| 8,708,750 | B2 * | 4/2014 | Ho | H01R 27/02 439/639 |
| 8,959,272 | B2 * | 2/2015 | Lamm | H01R 27/02 710/3 |

(Continued)

FOREIGN PATENT DOCUMENTS

| | | |
|---|---|---|
| CN | 202094446 U | 12/2011 |
| JP | 08-293353 A | 11/1996 |

(Continued)

*Primary Examiner* — Xuong Chung Trans

(74) *Attorney, Agent, or Firm* — Steven Reiss

(57) ABSTRACT

A connector, configured to extend a plurality of interfaces, includes a housing and a plurality of pins extending out of the housing. The housing is designed to accommodate a plurality of contacts spaced apart in sequentially numbered contact locations including HDMI contact locations designated for a HDMI port, configured to couple to at least one HDMI interface via HDMI pins of the plurality of pins; USB contact locations designated for a USB port; a power contact location designated for a power port; and a detection contact location designated for a detection port, configured to detect the types and quantities of the plurality of interfaces via a detection pin. A docking station and a connecting assembly with the connector are also provided.

20 Claims, 5 Drawing Sheets

(56) References Cited

U.S. PATENT DOCUMENTS

| | | | | |
|---|---|---|---|---|
| 9,136,636 | B2 * | 9/2015 | Zhang | H01R 13/516 |
| 9,166,350 | B2 * | 10/2015 | Zhang | H01R 27/00 |
| 2013/0217274 | A1 * | 8/2013 | Bar-Niv | H01R 27/02<br>439/676 |

FOREIGN PATENT DOCUMENTS

| | | | |
|---|---|---|---|
| JP | 3169392 | U | 7/2011 |
| KR | 10-2012-0099881 | A | 9/2012 |
| TW | M451723 | | 4/2013 |

* cited by examiner

CONNECTOR, DOCKING STATION AND CONNECTING ASSEMBLY WITH THE CONNECTOR

CROSS-REFERENCE TO RELATED APPLICATIONS

This application claims priority to U.S. Provisional Application No. 62/052,970 filed on Sep. 19, 2014 in the U.S. Intellectual Property Office, the contents of which are incorporated by reference herein.

FIELD

The subject matter herein generally relates to connectors and more specifically to a dynamically configurable connector, a docking station and a connecting assembly with the connector.

BACKGROUND

There exist two main types of computing platforms, personal computers and mobile devices. The personal computer typically includes a processing unit, a display monitor, a keyboard, a hard disk storage device, and one or more of I/O devices. The mobile device can include a processing unit and an I/O device such as a touch sensitive display. In terms of features and computing capability, the personal computer excels in this category when compared to a mobile device. However, in terms of portability and accessibility, mobile devices are the clear victors. Also, for a number of reasons (e.g. the different operating systems), mobile devices cannot execute the high performance software in the personal computers. Because of the shortcomings inherent in the mobile devices, users need to purchase both the personal computer for home or office use. When evaluating the problems of these respective platforms, there exists a problem where a tradeoff occurs between mobility and processing power.

BRIEF DESCRIPTION OF THE DRAWINGS

Implementations of the present technology will now be described, by way of example only, with reference to the attached figures.

DETAILED DESCRIPTION

Figure 1:
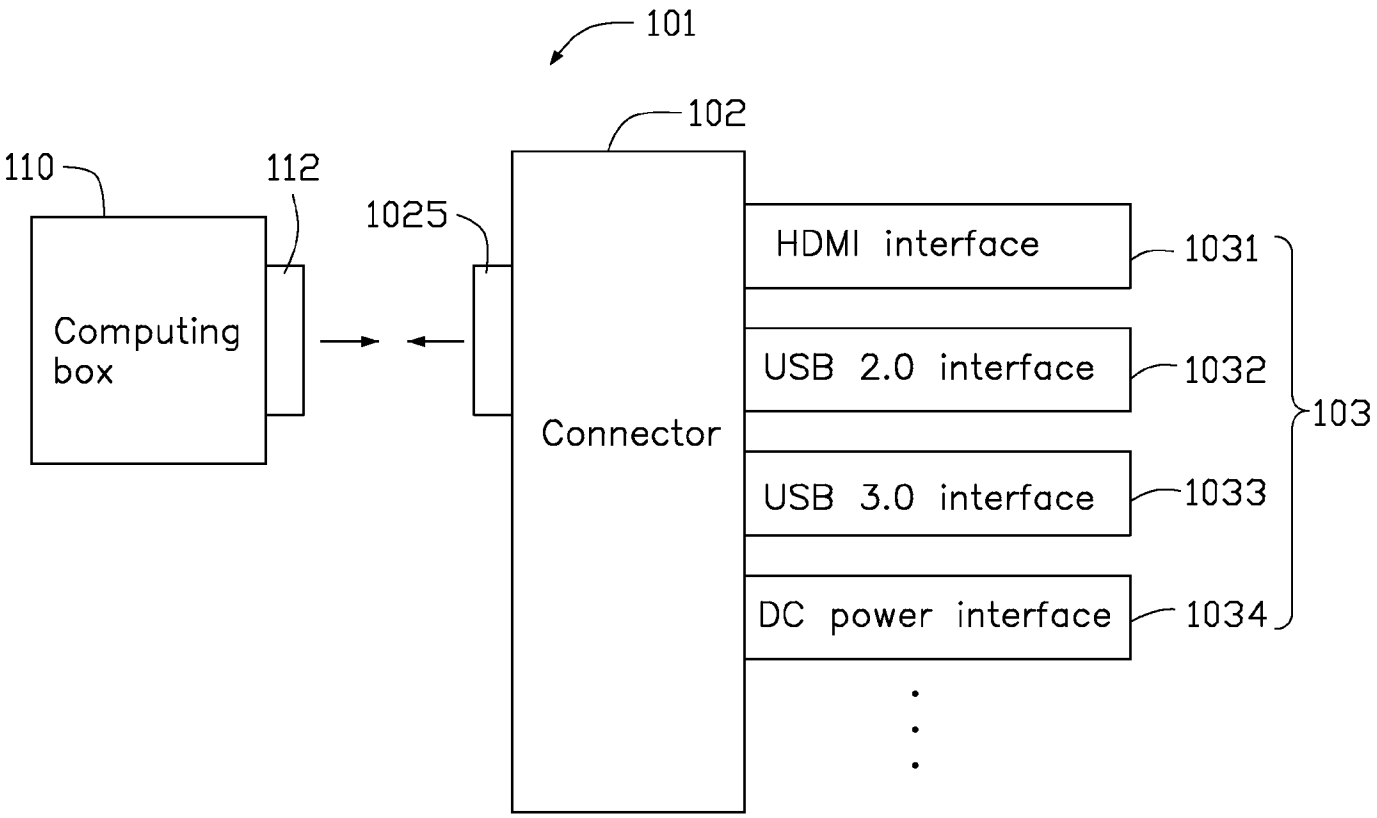
FIG. 1 is a schematic view of the connector, the connecting assembly, and a computing box.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

FIG. 1 illustrates a docking station 101 in accordance with an embodiment including a connector 102 and a plurality of interfaces 103 extending from the connector 102. The connector 102 is couplable to a computing box 110 with a coupled connector 112. The plurality of interfaces 103 have many different types, such as HDMI, USB 2.0, USB 3.0, DC-IN/OUT etc., so that the computing box 110 may easily connect with different types of docking stations 101 (Display docking station, AIO docking station, phone docking station etc.) and different accessories (e.g. a desktop PC, an AIO, or a phone, etc.) and users can arrange the computing box 110 and accessories in pairs based on personal needs, so the subject matter herein satisfies users' different requirement by combing advantages of portability, flexibility and diversity.

Figure 2:
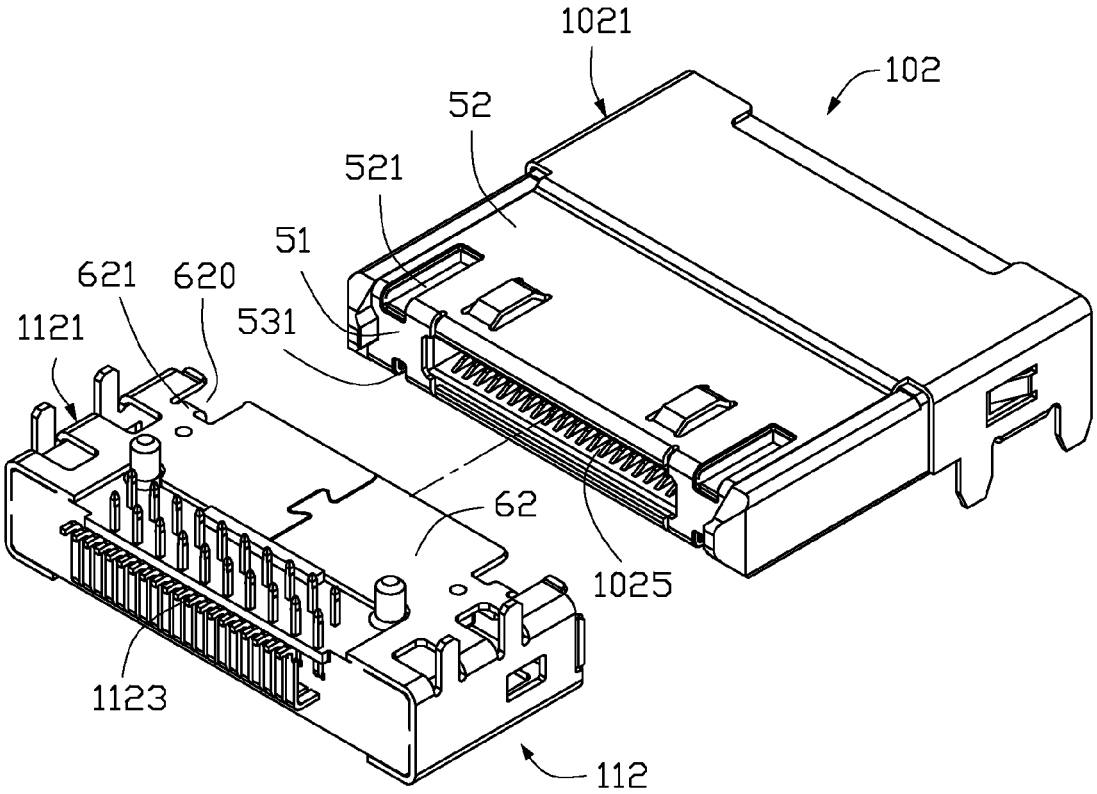
FIG. 2 is an exploded, isometric view of an embodiment of a connecting assembly with a connector and a coupled connector.
Figure 3:
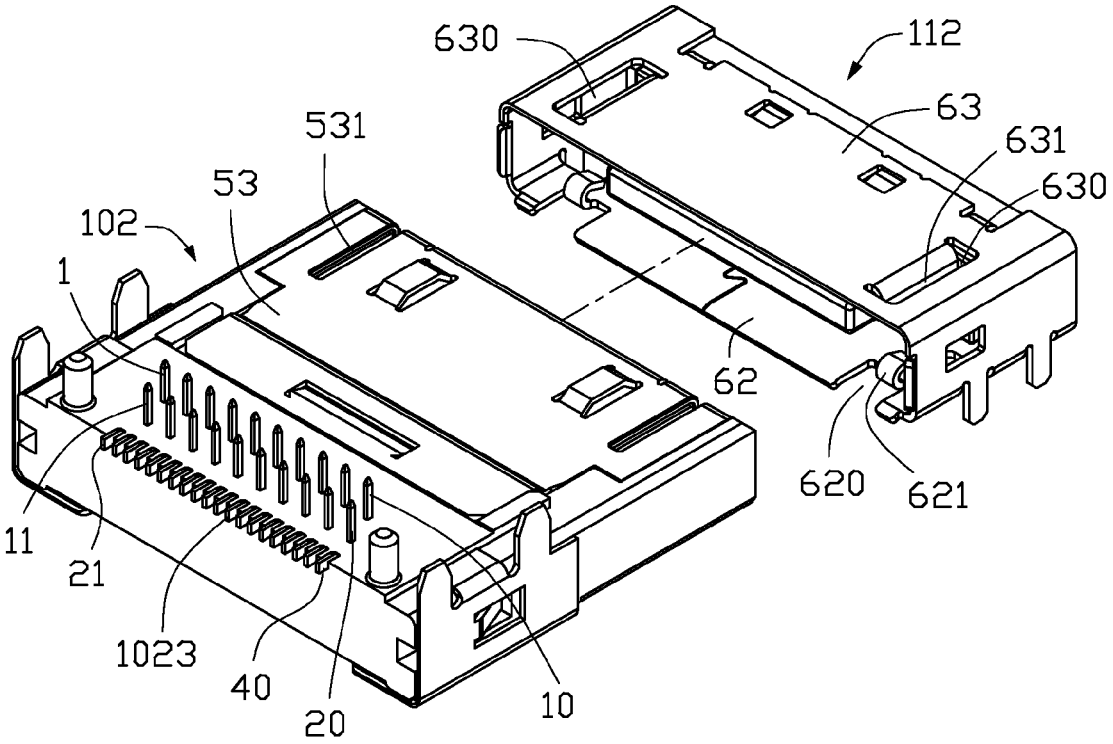
FIG. 3 is similar with FIG. 2, but viewed from a different angle.
Figure 4:
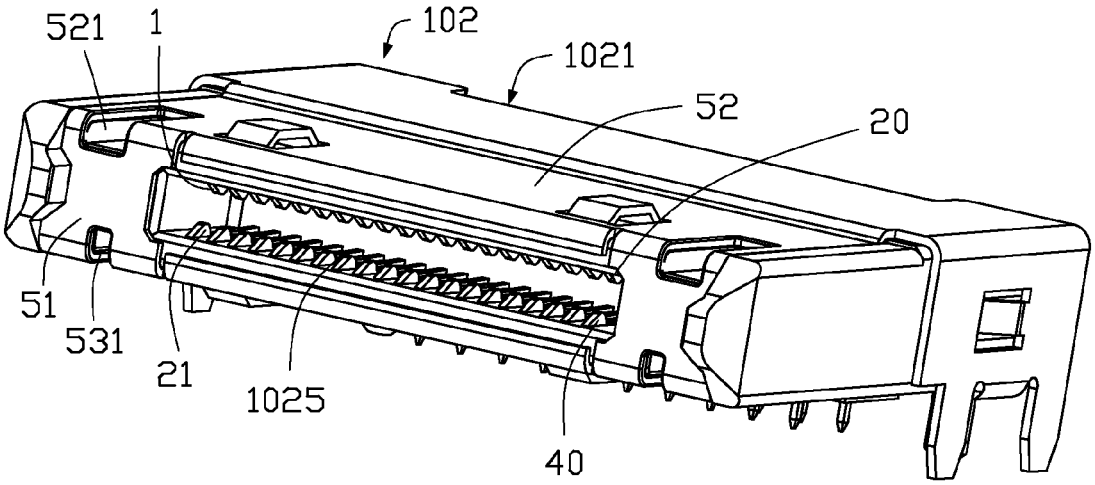
FIG. 4 is an isometric view of the connector assembly of FIG. 2.

FIGS. 2-4 illustrate that the connector 102 can include a housing 1021 and a pin area 1023 arranged in the housing 1021. The housing 1021 is designed to accommodate a plurality of contacts spaced apart in sequentially numbered contact locations 1025. The pin area 1023 has a plurality of pins 1-*n*. Each pin electronically extends from a contact in the corresponded contact location. The plurality of pins 1-*n* are arranged according to the sequentially numbered contact locations, such that, the first pin is pin 1 corresponding to contact location 1, the second pin is pin 2 corresponding to contact location 2 . . . the forty pin is pin 40 corresponding to contact location 40. In at least one embodiment, the sequentially numbered contact locations 1025 is arranged at two lines with each line having a same quantity.

The plurality of pins 1-*n* can include a high definition multimedia interface (HDMI) port, a universal serial bus (USB) 2.0 port, a USB 3.0 port, a DC-IN port, a detection port, a DC-OUT port, a control port, and a function extension port. In at least one embodiment, the quantity of the plurality of pins 1-*n* is at least 40. In this embodiment, the plurality of pins includes 40 pins, the first to twenty pins are arranged at two lines with each line having a same quantity, the $21^{st}$ to forty pins are arranged in a straight line attached to the housing 1021.

Sixteen of the 40 pins are combined to form the HDMI port, and the 16 pins are coupled to at least one HDMI interface 1031 of the plurality of interfaces 103.

Four of the 40 pins are combined to form the USB 2.0 port, and the 4 pins are coupled to at least one USB 2.0 interface 1032 of the plurality of interfaces 103.

Nine of the 40 pins are combined to form the USB 3.0 port, and the 9 pins are coupled to at least one USB 3.0 interface 1033 of the plurality of interfaces 103.

Two of the 40 pins are two DC-pin ports, and each of the 2 pins is coupled to at least one DC power interface 1034 of the plurality of interfaces 103.

Figure 5:
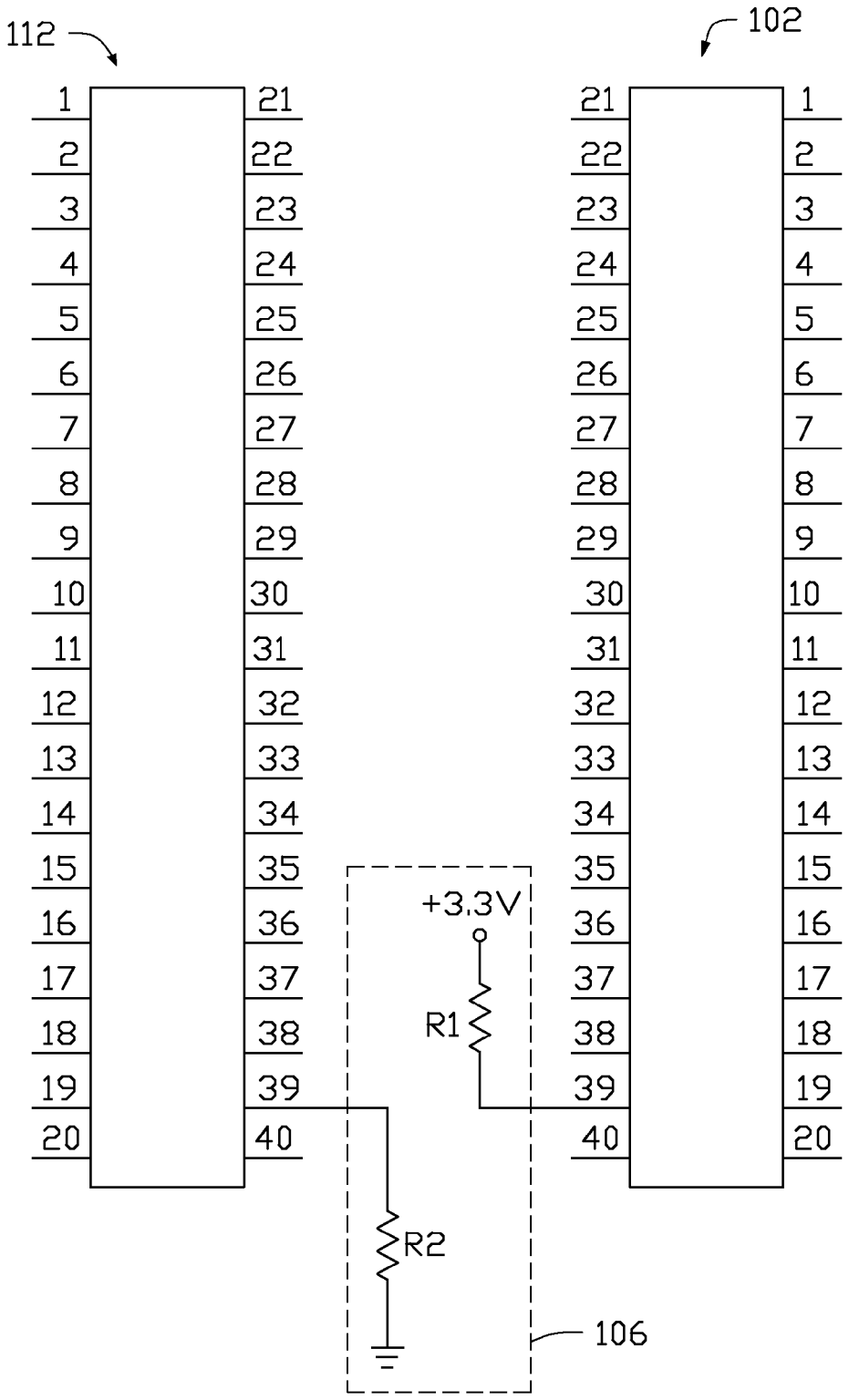
FIG. 5 is hardwired schematic view of the connecting assembly coupled to a detection circuit.

FIG. 5 illustrates that 2 of the 40 pins are two detection ports, one of the two detection port is coupled to the detection circuit 103. The coupled connector 112 is capable of identifying the type of the docking station 101.

The detection circuit 106 can include a pull-up resistor R1 coupled to the detection pin of the connector 102 and a pull-down resistor R2 coupled to the detection pine of the coupled connector 112. Different type docking station 101 has a different resistance pull-up resistor R1. When the connector 102 is coupled to the coupled connector 112, the pull-up resistor R1 is coupled to the pull-down resistor R2 in series. Thus, the voltage of the pull-down resistor R2 is different when different pull-up resistor R1 is coupled to the pull-down resistor R2, and the computing box 110 can identities the type of the docking station 101 according to the changed voltage. The different type of the docking stations 101 may have different type interfaces and/or number interface in an interface. For example, A typed docking station, such as a mobile phone docking station, has 1 HDMI port and 1 DC-IN port, and the pull-up resistor R1 is 10Ω; B typed docking station, such as a tablet PC docking station, has 1 USB 2.0 port, a USB 3.0 port, and 1 DC-IN port, and the pull-up resistor R1 is 8Ω; C typed docking station, such as a display docking station, has 1 HDMI port, a USB 2.0 port, 2 USB 3.0 port, and 2 DC-IN port, and the pull-up resistor R1 is 6Ω.

One of the 40 pins is the DC-out port, configured to provide a DC voltage, such as +3.3V, to an external circuit.

One of the 40 pins is the control port, configured to couple to a control circuit. In at least one embodiment, the control circuit is configured to power on/off the computing box 110.

Five of the 40 pins are the reserved function extension ports, each of the function extension port is couplable to a function extension circuit.

In at least one embodiment, the 40 pins are defined as the table below:

| Pin number | Pin name |
|---|---|
| 1 | +V5A_BOX_USB |
| 2 | +V5A_BOX_USB |
| 3 | +VHDMI_DOCK_R |
| 4 | HDMI_TX2_CMC_DN |
| 5 | HDMI_TX2_CMC_DP |
| 6 | GND |
| 7 | HDMI_TX0_CMC_DP |
| 8 | HDMI_TX0_CMC_DN |
| 9 | GND |
| 10 | HDMI_TX1_CMC_DP |
| 11 | HDMI_TX1_CMC_DN |
| 12 | GND |
| 13 | HDMI_CLK_CMC_DN |
| 14 | HDMI_CLK_CMC_DP |
| 15 | GND |
| 16 | HDMI_DDC_CLK_L |
| 17 | HDMI_DDC_DATA_L |
| 18 | HDMI_HPD_L |
| 19 | DC_IN |
| 20 | DC_IN |
| 21 | USB2_TYPE_C_DP |

-continued

| Pin number | Pin name |
|---|---|
| 22 | USB2_TYPE_C_DN |
| 23 | I2C_EC_SCL_DOCK |
| 24 | I2C_EC_SDA_DOCK |
| 25 | POWER_BUTTON_INPUT |
| 26 | GND |
| 27 | USB3_TXN2 |
| 28 | USB3_TXP2 |
| 29 | GND |
| 30 | USB3_RXP2 |
| 31 | USB3_RXN2 |
| 32 | GND |
| 33 | USB2_CPU_P3_DP |
| 34 | USB2_CPU_P3_DN |
| 35 | GND |
| 36 | USB2_CPU_P2_DP |
| 37 | USB2_CPU_P2_DN |
| 38 | +V3P3SX_R |
| 39 | Dock_ID |
| 40 | BASE_ACPRES_DOCK |

In this embodiment, pins 3-18 is the HDMI port, pin 3 therein is a HDMI DC-out pin, pins 6, 9, 12, and 15 are grounded pins, pins 4-5, 7-8, 10-11, 13-14, 16-17, and 18 are HDMI signal pins, that is contact location 3 is a HDMI power contact location designated for HDMI power output, contact locations 6, 9, 12, and 15 are ground contact locations designated for ground, and contact locations 4-5, 7-8, 10-11, 13-14, 16-17, and 18 are HDMI signal/data contact locations designated for HDMI signal/data.

Pins 1 or 2, and 32-34 is the USB 2.0 port, pin 1 or 2 therein is a USB 2.0 DC-out pin, pin 32 is grounded pin, pins 33-34 are USB 2.0 signal pins, that is contact location 2 or 1 is USB 2.0 power contact location designated for USB 2.0 power output, contact location 32 is a ground contact location designated for ground, and contact locations 33-34 are USB 2.0 signal/data contact locations designated for USB 2.0 signal/data.

Pins 2 or 1, and 27-31, and 35-37 is the USB 3.0 port, pin 2 or 1 therein is a USB 3.0 DC-out pin, pins 29 and 35 are grounded pin, pins 27-28, 30-31, and 36-37 are USB 3.0 signal pins, that is contact location 2 or 1 is a USB 3.0 power contact location designated for USB 3.0 power output, contact locations 29 and 35 are ground contact locations designated for ground, and contact locations 27-28, 30-31, and 36-37 are USB 3.0 signal/data contact locations designated for USB 3.0 signal/data.

Pins 19 and 20 are the DC-IN ports, accordingly, the contact locations 19 and 20 are power contact locations designated for power input.

Pins 39 and 40 are the detection ports, pin 39 is coupled to the detection circuit 106, accordingly, the contact locations 39 and 40 are detection contact locations designated for detection.

Pin 38 is the DC-OUT port, accordingly, the contact location 38 is a power contact location designated for power output.

Pin 25 is the control port configured to power on/off the computing box 110, accordingly, the contact location 25 is a control contact location designated for controlling the computing box or the docking station.

Pins 21-24 and 26 are function extension ports, pin 26 is a grounded pin, pins 21-22 can be USB function extension port, pins 23-24 can be I2C function extension port. In other embodiments, the function extension port can be an extension detection port configured to detect whether a DC power is inputted from the DC-IN port.

In other embodiments, the locations of the HDMI port, the USB 2.0 port, the UDB 3.0 port, the DC-IN port, the detection port, the control port, and the function extension port can be changed.

FIGS. 2-4 illustrate a connecting assembly in accordance with an embodiment including the connector 102 and the coupled connector 112. The housing 1021 can include a front wall 51, a top wall 52, and a bottom wall 53 opposite to the top wall 52. The front wall 51 is substantially perpendicular to the top wall 52 and the bottom wall 53, and the top wall 52 is substantially parallel to the bottom wall 53. Each of two opposite ends of the top wall 52 defines a first guiding slot 521, and the first guiding slot 521 extends to the front wall 51. Each of two opposite ends of the bottom wall 53 defines a second guiding slot 531, and the second guiding slot 531 extends to the front wall 51. An extension direction of the first guiding slot 521 is substantially parallel to that of the second guiding 531 and perpendicular to the front wall 51. A width of the first guiding slot 521 is less than that of the second guiding slot 531. A direction of the width is perpendicular to the extension direction.

The coupled connector 112 can include an enclosure 1121 and a pin area 1123 arranged on the enclosure 1121. The enclosure 1121 can include a top plate 62 and a bottom plate 63 opposite to the top plate 62. The top plate 62 is substantially parallel to the bottom plate 63. Each of two opposite ends of the top plate 62 defines a cutout 620, and a first limiting piece 621 extends from an edge of the cutout 620. The first limiting piece 621 is curved. A width of the first limiting piece 621 is less than the width of the first guiding slot 521 and greater than the width of the second guiding slot 531. Each of two opposite ends of the bottom plate 63 defines an opening 630, and a second limiting piece 631 perpendicularly extends from an edge of the opening 630 towards the top plate 62. A width of the second limiting piece 631 is less than the width of the second guiding slot 531. The width direction of the first limiting piece 621 and the second limiting piece 631 is parallel to the first guiding slot 521 and the second guiding slot 531.

When the connector 102 is correctly coupled to the coupled connector 112, the first limiting piece 621 is slidable received in the first guiding slot 521, and the second limiting piece 631 is slidable received in the second guiding slot 531.

When the connector 102 is incorrectly coupled to the coupled connector 112, the first limiting piece 621 is blocked by edges of the first guiding slot 521, preventing the connector 102 from being inserted into the coupled connector 112.

The embodiments shown and described above are only examples. Many details are often found in the art such as the other features of a connector, docking station, and connecting assembly with the connector. Therefore, many such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A connector, configured to couple a plurality of interfaces, comprising:

a housing and a plurality of pins extending out of the housing;

wherein the housing being designed to accommodate a plurality of contacts spaced apart in sequentially numbered contact locations comprising:

high definition multimedia interface (HDMI) contact locations designated for a HDMI port and configured to couple to at least one HDMI interface via HDMI pins of the plurality of pins;

universal serial bus (USB) contact locations designated for a USB port and configured to couple to at least one USB interface via USB pins of the plurality of pins;

a power contact location designated for a power port and configured to couple to at least one power interface via a power pin of the plurality of pins; and a detection contact location designated for a detection port and configured to couple to a detection circuit to detect the types and quantities of the plurality of interfaces via a detection pin of the plurality of pins according to different voltages of the detection pin when the detection port is coupled to the detection circuit.

2. The connector of claim 1, wherein the housing comprising a top wall and a bottom wall opposite to the top wall, the top wall defines a first guiding slot, the bottom wall defines a second guiding slot, an extending direction of the first guiding slot is substantially parallel to an extending direction of the second guiding slot, and a width of the first guiding slot is greater than a width of the second guiding slot.

3. The connector of claim 1, wherein the sequentially numbered contact locations comprising at least 40 contact locations, and the at least 40 contact locations comprising:

16 contact locations designated for the HDMI contact locations;

4 contact locations designated for a USB 2.0 contact locations;

9 contact locations designated for a USB 3.0 contact locations.

4. The connector of claim 3, wherein the HDMI contact locations are contact locations 3-18, contact location 3 is designated for HDMI power output, contact locations 6, 9, 12, and 15 are ground contact locations designated for ground, and contact locations 4-5, 7-8, 10-11, 13-14, 16-17, and 18 are HDMI signal/data contact locations designated for HDMI signal/data.

5. The connector of claim 3, wherein the USB 2.0 contact locations are contact locations 1 and 32-34, contact location 1 is USB 2.0 power contact location designated for USB 2.0 power output, contact location 32 is a ground contact location designated for ground, and contact locations 33-34 are USB 2.0 signal/data contact locations designated for USB 2.0 signal/data.

6. The connector of claim 3, wherein the USB 3.0 contact locations are contact locations 2, 27-31, and 35-37, contact location 2 is a USB 3.0 power contact location designated for USB 3.0 power output, contact locations 29 and 35 are ground contact locations designated for ground, and contact locations 27-28, 30-31, and 36-37 are USB 3.0 signal/data contact locations designated for USB 3.0 signal/data.

7. The connector of claim 1, wherein the sequentially numbered contact locations further comprises a power contact location 19 designated for the power contact location, another power contact location 20 designated for power input signal, and power contact location 38 designated for power output signal.

8. The connector of claim 1, wherein the sequentially numbered contact locations further comprises a control contact location 25 designated for a power on/off control signal.

9. The connector of claim 1, wherein the sequentially numbered contact locations further comprises extension contact locations 21-24 designated for an extension circuit signal.

10. The connector of claim 1, wherein the detection contact location is designated for coupling to the detection circuit to detect the types and quantities of the plurality of interfaces according to different voltages of the detection pin when the detection port is coupled to the detection circuit.

11. A docking station comprising:

a connector and a plurality of interfaces couplable to the connector;

wherein the connector comprising:

a housing and a plurality of pins extending out of the housing;

wherein the housing being designed to accommodate a plurality of contacts spaced apart in sequentially numbered contact locations comprising:

high definition multimedia interface (HDMI) contact locations designated for a HDMI port and configured to couple to at least one HDMI interface via HDMI pins of the plurality of pins;

universal serial bus (USB) contact locations designated for a USB port and configured to couple to at least one USB interface via USB pins of the plurality of pins;

a power contact location designated for a power input port and configured to couple to at least one power output interface via a power input pin of the plurality of pins;

another power contact location designated for a power output port and configured to couple to at least one power input interface via a power output pin of the plurality of pins; and a detection contact location designated for a detection port and configured to couple to a detection circuit to detect the types and quantities of the plurality of interfaces via a detection pin of the plurality of pins.

12. The docking station of claim 11, wherein the housing comprising a top wall and a bottom wall opposite to the top wall, the top wall defines a first guiding slot, the bottom wall defines a second guiding slot, an extending direction of the first guiding slot is substantially parallel to an extending direction of the second guiding slot, and a width of the first guiding slot is greater than a width of the second guiding slot.

13. The docking station of claim 11, wherein the sequentially numbered contact locations comprising at least 40 contact locations, and the at least 40 contact locations comprising:

16 contact locations designated for the HDMI contact locations;

4 contact locations designated for a USB 2.0 contact locations;

9 contact locations designated for a USB 3.0 contact locations.

14. The docking station of claim 13, wherein the HDMI contact locations are contact locations 3-18, contact location 3 is designated for HDMI power output, contact locations 6, 9, 12, and 15 are ground contact locations designated for ground, and contact locations 4-5, 7-8, 10-11, 13-14, 16-17, and 18 are HDMI signal/data contact locations designated for HDMI signal/data.

15. The docking station of claim 13, wherein the USB 2.0 contact locations are contact locations 1 and 32-34, contact location 1 is USB 2.0 power contact location designated for USB 2.0 power output, contact location 32 is a ground contact location designated for ground, and contact locations 33-34 are USB 2.0 signal/data contact locations designated for USB 2.0 signal/data.

16. The docking station of claim 13, wherein the USB 3.0 contact locations are contact locations 2, 27-31, and 35-37, contact location 2 is a USB 3.0 power contact location designated for USB 3.0 power output, contact locations 29 and 35 are ground contact locations designated for ground, and contact locations 27-28, 30-31, and 36-37 are USB 3.0 signal/data contact locations designated for USB 3.0 signal/data.

17. The docking station of claim 11, wherein the sequentially numbered contact locations further comprises a control contact location 25 designated for a power on/off control signal.

18. A connecting assembly comprising:

a coupled connector; and a connector couplable to the coupled connector, the connector being configured to extend a plurality of interfaces couplable to the connector;

wherein the connector comprising:

a housing and a plurality of pins extending out of the housing;

wherein the housing being designed to accommodate a plurality of contacts spaced apart in sequentially numbered contact locations comprising:

high definition multimedia interface (HDMI) contact locations designated for a HDMI port and configured to couple to at least one HDMI interface via HDMI pins of the plurality of pins;

universal serial bus (USB) contact locations designated for a USB port and configured to couple to at least one USB interface via USB pins of the plurality of pins;

a power contact location designated for a power port and configured to couple to at least one power interface via a power pin of the plurality of pins; and a detection contact location designated for a detection port and configured to couple to a detection circuit to detect the types and quantities of the plurality of interfaces via a detection pin of the plurality of pins according to different voltages of the detection pin when the detection port is coupled to the detection circuit.

19. The connecting assembly of claim 18, wherein the housing comprising a top wall and a bottom wall opposite to the top wall, the top wall defines a first guiding slot, the bottom wall defines a second guiding slot, an extending direction of the first guiding slot is substantially parallel to an extending direction of the second guiding slot, and a width of the first guiding slot is greater than a width of the second guiding slot.

20. The connecting assembly of claim 19, wherein the coupled connector comprises an enclosure, the enclosure comprises a top plate and a bottom plate opposite to the top plate, the top plate defines a cutout, and a first limiting piece extends from an edge of the cutout, the bottom plate defines an opening, a second limiting piece extends from an edge of the opening towards the top plate, a width of the second limiting piece is less than a width of the second guiding slot, and a width of the first limiting piece is less than a width of the first guiding slot and greater than the width of the second guiding slot.

* * * * *